US006280857B1

(12) United States Patent
Sommer et al.

(10) Patent No.: US 6,280,857 B1
(45) Date of Patent: Aug. 28, 2001

(54) HIGH TEMPERATURE PROTECTIVE COATING

(75) Inventors: Marianne Sommer, Walldorf; Hans-Peter Bossmann, Wiesloch, both of (DE); Maxim Konter, Klingnau (CH); Peter Holmes, Winkel (CH); Christoph Toennes, Brugg (CH); Hans Joachim Schmutzler, Maikammer (DE)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/343,426

(22) Filed: Jun. 30, 1999

Related U.S. Application Data

(63) Continuation of application No. PCT/EP97/06000, filed on Oct. 30, 1997.

(51) Int. Cl.[7] ..... B32B 15/00; C22C 19/05

(52) U.S. Cl. ..... 428/633; 428/678; 428/680; 420/442; 420/444; 420/445; 420/456; 420/460

(58) Field of Search ..... 428/615, 621, 428/629, 632–633, 678, 680; 148/410, 428; 420/442, 444, 445, 456, 460

(56) References Cited

U.S. PATENT DOCUMENTS

| | | | | |
|---|---|---|---|---|
| 4,419,416 | * | 12/1983 | Gupta et al. | 428/656 |
| 4,447,503 | * | 5/1984 | Dardi et al. | 428/632 |
| 4,758,480 | * | 7/1988 | Hect et al. | 428/680 |
| 5,035,958 | * | 7/1991 | Jackson et al. | 428/553 |
| 5,077,141 | * | 12/1991 | Naik et al. | 428/680 |

* cited by examiner

*Primary Examiner*—Deborah Jones
*Assistant Examiner*—Bryant Young

(57) ABSTRACT

A coating composition for superalloy structural parts, especially, for gas turbine vanes and blades, which has high resistance to oxidation and corrosion and has excellent mechanical behavior. The coating preferably comprises: 18 to 28 wt % of Co; 11 to 15 wt % of Cr; 11.5 to 14 wt % of Al; 1 to 8 wt % of Re; 1 to 2.3 wt % of Si; 0.2 to 1.5 wt % of Ta; 0.2 to 1.5 wt % of Nb; 0.3 to 1.3 wt % of Y; 0 to 1.5 wt % of Mg; 0 to 0.5 wt % of a total of La and La-series; 0 to 0.1 wt % of B; less than 0.1 wt % of Hf; and less than 0.1 wt % of C. The balance of the coating is Ni. A total of Y, La, and La-series is from 0.3 to 2.0 wt %, and a total of Si and Ta is equal to or less than 2.5 wt %.

15 Claims, 6 Drawing Sheets

HIGH TEMPERATURE PROTECTIVE COATING

CROSS REFERENCE TO RELATED APPLICATION

This is a continuation of international application No. PCT/EP97/06000, filed Oct. 30, 1997, which designated the United States.

BACKGROUND OF THE INVENTION

FIELD OF THE INVENTION

The invention relates to an improved class of protective coatings for superalloy structural parts, especially for gas turbine vanes and blades.

In the field of gas turbine engines, designers continually look toward raising the operating temperature of the engine to increase efficiency. In turn, the oxidation rate of materials increases dramatically with increasing temperature. Gas turbine components can also be subjected to hot corrosion, when corrosive species are ingested into the engine via intake air and/or impurities in the fuel. Modern structural superalloys are designed for the ultimate in mechanical properties thereby sacrificing oxidation, and, to an even larger extent corrosion resistance.

To increase the useful life of gas turbine components it is customary to use protective coatings, such as aluminide or MCrAlY coatings where M may be Ni, Co, Fe or mixtures thereof. Since a coated turbine blade undergoes complicated stress states during operation, i.e. during heating and cooling cycles, advanced high temperature coatings must not only provide environmental protection but must also have specifically tailored physical and mechanical properties.

If the protective coating is to be used as a bond coat for thermal barrier coatings (TBCs) there are additional requirements. For an overlay coating, i.e. no TBC, the thermally grown oxide can spall and regrow provided that the activity of Al in the coating remains sufficiently high. For a TBC bond coat, oxide growth rate and oxide scale adherence are the life controlling parameters since if the oxide spalls, the TBC will spall. In summary, advanced high temperature protective coatings must have: a high oxidation resistance; a slowly growing oxide scale (low kp value); a good oxide scale adherence; a hot corrosion resistance, superior to SX/DS superalloys; a low interdiffusion of Al and Cr into the substrate to prevent the precipitation of brittle needle-like phases under the coating; a creep resistance comparable to conventional superalloys; a high ductility at low temperatures and a low ductile brittle transition temperature; and a thermal expansion coefficient similar to the substrate over the entire temperature range.

U.S. Pat. Nos. 5,273,712 and 5,154,885 disclose coatings with significant additions of Re which simultaneously improve the creep and oxidation resistance at high temperatures. However, the combination of Re with high Cr levels, which is typical with traditional coatings, results in an undesirable chase structure of the coating and the interdiffusion layer. At intermediate temperatures (below 950–900° C.), α-Cr phase is more stable in the coating than the γ-matrix. This results in low toughness and low ductility. In addition, a significant excess of Cr in the coating compared to the substrate results in diffusion of Cr to the base alloy, which enhances precipitation of needle-like Cr—, W— and Rerich phases.

U.S. Pat. No. 4,758,480 discloses a class of protective coatings whose compositions are based on the compositions of the underlying substrate. The similarities in microstructure (gamma prime phase in gamma matrix) render the mechanical properties of the coating similar to the mechanical properties of the substrate, thereby reducing thermomechanically induced damage during service. However, the amount of Al (7.5–11 wt %) and Cr (9–16 wt %) in the coating may not provide sufficient oxidation and/or corrosion resistance for the long exposure times that are customary in stationary gas turbines.

SUMMARY OF THE INVENTION

It is accordingly an object of the invention to provide a new coating for structural parts of gas turbines, especially for blades and vanes, which overcomes the above-mentioned disadvantages of the heretofore-known coatings, which exhibits improved mechanical behavior and which provides sufficient oxidation/corrosion resistance for the long exposure times that are customary in stationary gas turbines.

A nickel base alloy is provided that is particularly adapted for use as a coating for advanced gas turbine blading. The alloy is prepared with the elements in an amount to provide an alloy composition as shown in Table 1.

TABLE 1

Range of Coating Compositions of Present Invention

| | Elements of composition (% by weight) | | | | | | | | | | | |
|---|---|---|---|---|---|---|---|---|---|---|---|---|
| | Ni | Co | Cr | A | Re | Y | Si | Ta | Nb | La* | Mg | B |
| Coating | bal. | 18–28 | 11–15 | 11.5–14 | 1–8 | 0.3–1.3 | 1–2.3 | 0.2–1.5 | 0.2–1.5 | 0–0.5 | 0–1.5 | 0–0.1 |

La* = La + elements from Lanthanide series
Y + La (+ La-series) ≦ 0.3 – 2.0
Si + Ta ≦ 2.5 wt %
Hf, C < 0.1 wt %

The alloy simultaneously provides optimum oxidation and corrosion resistance, phase stability during diffusion heat treatment and during service, and excellent mechanical behavior, especially high ductility, high creep resistance, and thermal expansion similar to the substrate.

This is achieved by a specific phase structure consisting of β-reservoir phase precipitates (45–60 vol %) in a ductile γ-matrix (40–55 vol %).

Preferably, the alloy can be produced by a vacuum melt process in which powder particles are formed by inert gas atomization. The powder can then be deposited on a substrate using, for example, thermal spray methods. However, other methods of application may also be used. Heat treatment of the coating using appropriate times and temperatures is recommended to achieve a good bond to the substrate and a high sintered density of the coating.

A number of different alloys with compositions according to the present invention, which have been tested, are given in Table 2(a).

TABLE 2(a)

Preferred Coating Compositions

| | Elements in wt % of composition | | | | | | | | | | |
|---|---|---|---|---|---|---|---|---|---|---|---|
| | Ni | Co | Cr | Al | Re | Y | Si | Ta | Nb | La | Mg |
| PC1 | bal. | 24.1 | 11.8 | 12.1 | 2.8 | 0.3 | 1 | 1 | 0.3 | — | — |
| PC2 | bal. | 23.8 | 13 | 12 | 3 | 0.5 | 1.7 | 0.5 | 0.3 | — | 0.2 |
| PC3 | bal. | 23.8 | 13 | 11.8 | 3 | 0.3 | 1 | 1 | 0.3 | 0.1 | — |

These preferred alloys exhibit the desired coating behavior with optimum oxidation and corrosion resistance, phase stability during diffusion heat treatment and during service, and excellent mechanical behavior, especially high ductility, high creep resistance, and thermal expansion similar to the CMSX4 substrate material.

In order to prove the advantage of the preferred compositions a number of additional alloys whose compositions are given in Table 2(b) have also been tested. Alloys EC1–EC8 were found to exhibit poor properties in comparison with the preferred compositions PCI, PC2, and PC3.

TABLE 2(b)

Additional Coating Compositions

| Coating | Ni | Co | Cr | Al | Re | Y | Si | Ta | Nb | Hf |
|---|---|---|---|---|---|---|---|---|---|---|
| EC1 | bal. | 12 | 20.5 | 11.5 | — | 0.5 | 2.5 | 1 | — | — |
| EC2 | bal. | 12 | 16 | 11.5 | — | 0.3 | 2.5 | 1 | — | — |
| EC3 | bal. | 24 | 16 | 11 | — | 0.3 | 2 | 1 | — | — |
| EC4 | bal. | 24 | 13 | 11 | 3 | 0.3 | 2 | — | 0.5 | — |
| EC5 | bal. | 24 | 13 | 11.5 | 3 | 0.3 | 1.2 | — | — | 0.5 |
| EC6 | bal. | 24 | 14 | 11 | — | 0.3 | 2 | 0.5 | — | 0.5 |
| EC7 | bal. | — | 16 | 8 | — | 0.5 | 2 | 0.5 | — | — |
| EC8 | bal. | 12 | 8.5 | 7 | 3 | 0.5 | 1 | 3 | 0.3 | 0.7 |

TABLE 2(c)

| | Composition of CMSX4 (Single Crystal Base Material) | | | | | | | | | |
|---|---|---|---|---|---|---|---|---|---|---|
| | Ni | Co | Cr | Al | Re | W | Mo | Ta | Ti | Hf |
| CMSX4 | bal. | 10 | 6.5 | 5.6 | 2.8 | 6.4 | 0.5 | 6.5 | 1 | 0.1 |

The beneficial phase structure of the preferred alloy compositions (β-phase in ductile γ matrix) is reflected by the results of tensile tests at RT and 400° C. (Table 3). While tensile specimens coated with EC1 fail below 0.4% strain, specimens coated with the preferred compositions show tensile elongations of >4% and >9% at RT and 400° C., respectively.

TABLE 3

Strain to Failure of selected coatings at RT and 400° C.

| coating | strain to failure at RT (%) | Strain to failure at 400° C. |
|---|---|---|
| EC1 | <0.4 | <0.4 |
| EC2 | 0.8 | 1.9 |

TABLE 3-continued

Strain to Failure of selected coatings at RT and 400° C.

| coating | strain to failure at RT (%) | Strain to failure at 400° C. |
|---|---|---|
| EC3 | 2 | 4.5 |
| EC4 | 2.2 | 4.8 |
| 1, PC2, PC3 | >4 | >9 |

In addition, experimental TMF data (Table 4) show that the improved coatings of this invention also have superior TMF behavior. In contrast to coating EC1 which cracks at the is first cycle and a conventional overlay coating which fails after 2000 cycles, the coatings according to the present invention have a TMF life of >3000 cycles, i.e. very similar to that of the uncoated single crystal base alloy.

TABLE 4

TMF life of selected coatings

| coating | No of cycles at failure |
|---|---|
| EC1 | 1 |
| EC2 | <10 |
| conventional coating | 2000 |
| PC1, PC2, PC3 | >3000 |

The stable phase structure of the preferred compositions (45–60 vol % β and 55–40 vol % γ) is found to result in extremely high mechanical properties of coated specimens or components. This balance of two phases provides a unique combination of high TMF resistance and excellent oxidation resistance. Thermal expansion, ductility, and TMF resistance are on the level of the best γ–γ' systems (such as single crystal superalloys), yet, the presence of the β reservoir phase results in an oxidation life which γ–γ' systems cannot achieve.

It is important to understand that only the combination of the elements shown in Table 1 results in the desirable ⊖+γ phase structure (in the specified phase proportions) with excellent oxidation/corrosion resistance and excellent mechanical properties. The excess of alloying elements, such as Cr, Al, Ta, Si, Nb, Co, Re, results in the precipitation of detrimental σ, Heusler-, or r-phases.

Levels of Al, Cr, Re, and Si lower than that specified lead to reduced oxidation and/or corrosion resistance. The reduction of the Ta and Nb content, or the absence of at least one of the elements increases the rate of oxide growth, and hence, should be avoided when the coating is to be used as a TBC bond coat.

Changing the balance between Al, Cr, and Co may result in a similar initial phase structure but this phase structure is not expected to be stable during service. Phase transformations have been shown to result in an increased thermal expansion mismatch between the coating and the substrate (as shown) and therefore reduce the service life.

With the foregoing and other objects in view there is provided, in accordance with the invention, a coating composition for superalloy structural parts, including: 18 to 28 wt % of Co; 11 to 15 wt % of Cr; 11.5 to 14 wt % of Al; 1 to 8 wt % of Re; 1 to 2.3 wt % of Si; 0.2 to 1.5 wt % of Ta; 0.2 to 1.5 wt % of Nb; 0.3 to 1.3 wt % of Y; 0 to 1.5 wt % of Mg; 0 to 0.5 wt % of a total of La and La-series; 0 to 0.1 wt % of B; less than 0.1 wt % of Hf; less than 0.1 wt % of C; and the balance of the coating is Ni. A total of Y, La, and La-series is from 0.3 to 2.0 wt %; and a total of Si and Ta is equal to or less than 2.5 wt %.

In accordance with an added feature of the invention, the coating composition contains a phase structure of ductile γ matrix including P precipitates that are beneficial for oxidation and corrosion resistance and mechanical behavior.

In accordance with an additional feature of the invention, the coating composition is in a powder form.

In accordance with an another feature of the invention, the coating composition contains: about 24.1 wt % of Co; about 11.8 wt % of Cr; about 12.1 wt % of Al; about 2.8 wt % of Re; about 1 wt % of Si; about 0.3 wt % of Y; about 1 wt % of Ta; about 0.3 wt % Nb; and the balance of the coating is Ni. A total of Y, La, and La-series is from 0.3 to 2.0 wt %; and a total of Si and Ta is equal to or less than 2.5 wt %.

In accordance with a further feature of the invention, the coating composition contains: about 23.8 wt % of Co; about 13 wt % of Cr; about 12 wt % of Al; about 3 wt % of Re; about 1.7 wt % of Si; about 0.5 wt % of Y; about 0.5 wt % of Ta; about 0.3 wt % Nb; about 0.2 wt % of Mg; and the balance of the coating is Ni. A total of Y, La, and La-series is from 0.3 to 2.0 wt %; and a total of Si and Ta is equal to or less than 2.5 wt %.

In accordance with a further feature of the invention, the coating composition contains: about 23.8 wt % of Co; about 13 wt % of Cr; about 11.8 wt % of Al; about 3 wt % of Re; about 1 wt % of Si; about 0.3 wt % of Y; about l wt % of Ta; about 0.3 wt % Nb; about 0.1 wt % of La; and the balance of the coating is Ni. A total of Y, La, and La-series is from 0.3 to 2.0 wt %; and a total of Si and Ta is equal to or less than 2.5 wt %.

With the foregoing and other objects in view there is also provided, in accordance with the invention, a coated substrate including: a substrate selected from the group consisting of Ni-base and Co-base superalloys; and a layer of the coating composition disposed on the substrate.

In accordance with yet an added feature of the invention, a layer of a thermal barrier coating is disposed on the layer of the coating composition.

With the foregoing and other objects in view there is also provided, in accordance with the invention, a coated substrate including a substrate; a layer of the coating composition disposed on the substrate; and a layer of a thermal barrier coating disposed on the layer of the coating composition.

With the foregoing and other objects in view there is also provided a method of coating superalloy structural parts, in accordance with the invention, which includes: providing a substrate; and depositing a powder composition to provide a layer of a coating on the substrate. The powder composition is the coating composition.

Other features which are considered as characteristic for the invention are set forth in the appended claims.

Although the invention is illustrated and described herein as embodied as a High Temperature Protective Coating, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 6(*b*) is a graph showing the X-ray intensity as a function of oxidation time, by in situ X-ray analysis during oxidation at 1000° C., for the case when transient oxide formation takes place;

FIG. 7(*b*) is a graph showing the equilibrium phase structures for the experimental coating composition EC7.

DESCRIPTION OF THE PREFERRED EMBODIMENTS

Figure 1:
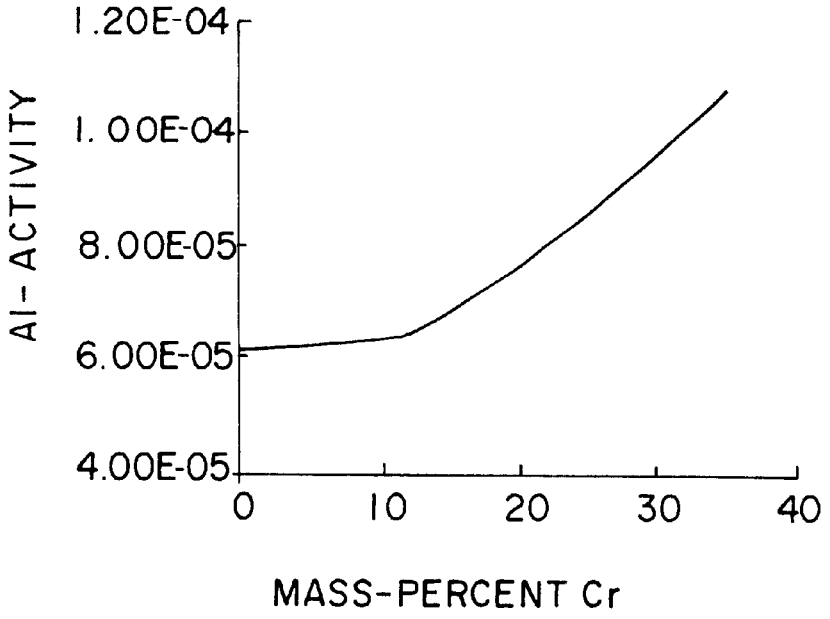
FIG. 1 is a graph showing the Al-activity as a function of the Cr content in the alloy (other elements are as follows: 12.1% Al, 24.1% Co, 3% Re, 1% Si, 0.5% Ta)
Figure 2:
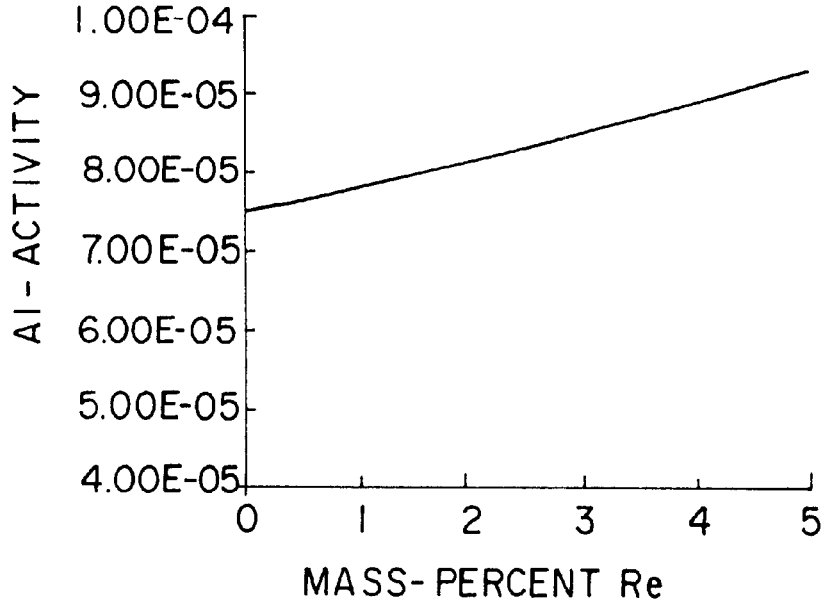
FIG. 2 is a graph showing the Al-activity as a function of the Re content in the alloy (other elements as follows: 12.1% Al, 11.8% Cr, 24.1% Co, 1% Si, 0.5% Ta)
Figure 3:
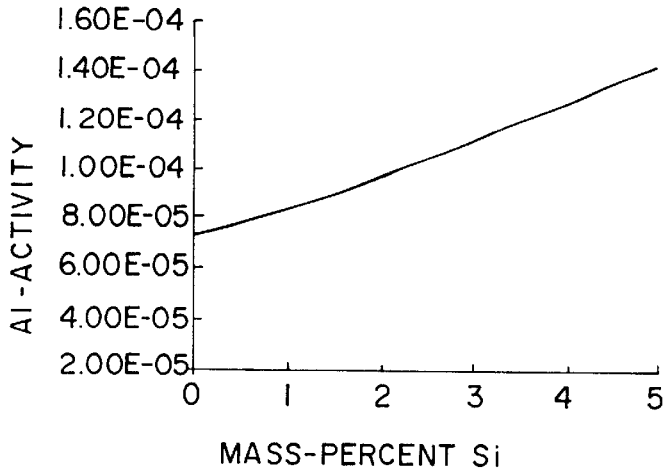
FIG. 3 is a graph showing the Al-activity as a function of the Si content in the alloy (other elements as follows: 12.1% Al, 11.8% Cr, 24.1% Co, 3% Re, 0.5% Ta)

The oxidation resistance of the alloy has been found to be determined mainly by its Al content, i.e. by the reservoir of Al atoms available to form a protective $Al_2O_3$ scale, and by the activity of Al in the system. The activity of Al is strongly influenced by the presence of other elements in the alloy and by the alloy phase structure which determines Al-diffusion. Modeling results showing the influence of Cr, Re and Si on Al activity, and hence, the oxidation resistance of the alloy are presented in FIGS. 1–3.

Upon oxidation, the alloy shows an increase in weight due to the uptake of oxygen. The weight gain of the alloy as a function of oxidation time follows a parabolic rate law, if the growing oxide scale is protective. Obviously, a small weight increase indicates a slowly growing oxide scale and, thus, is a desirable property.

Figure 4:
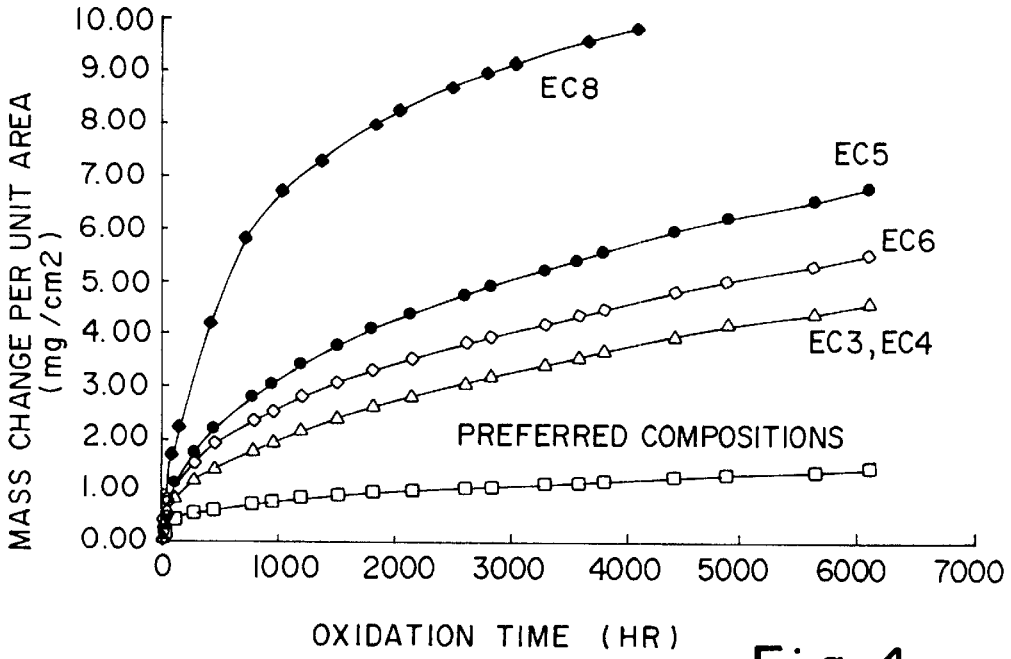
FIG. 4 is a graph showing the mass increase per unit area as a function of the oxidation time, as a result of oxidation at 1000° C. of the preferred coating compositions PC1, PC2, PC3 and of the experimental coatings EC3, EC4, ECS, EC6, and EC8.

FIG. 4 shows experimental data illustrating that the weight change is lower for the preferred alloy compositions than for the experimental alloys EC3, EC4, EC5, EC6, and EC8. The poor oxidation behavior of EC8 illustrates the necessity of having a sufficiently high content of Al and of other elements supporting the Al activity in the alloy.

Apparently, certain elements in the preferred composition act by modifying the oxide layer so as to render it more resistant to the inward diffusion of oxygen or the outward diffusion of Al. Oxide growth continues until a critical oxide thickness is reached and spallation occurs. As long as the Al content and the Al activity in the alloy remain sufficiently high, the $Al_2O_3$ scale can grow and spall repeatedly.

Typically, MCrAlY coatings contain 0.5 to 1 wt % of Y, which has a powerful effect on the oxidation resistance of the alloy. In some fashion, Y acts to improve the adherence of the oxide scale which forms on the coating, thereby substantially reducing spallation. A variety of other so-called oxygen active elements (La, Ce, Zr, Hf, Si) have been proposed to replace or supplement the Y content.

In the present invention, Y is added in amounts on the order of 0.3 to 1.3 wt %, and La and elements from the Lanthanide series are added in amounts ranging from 0 to 0.5 wt %. Surprisingly, Hf was found to increase the rate of oxide growth. The difference in oxidation rate for the preferred alloy compositions (i.e. Hf-free) and Hf-containing alloys (EC5, EC6, and EC8) is shown in FIG. 4. Energy dispersive X-ray analysis revealed the presence of Hf carbides in Hf-containing alloys which are likely to reduce oxidation resistance.

Nb and Ta, on the other hand, were found to increase oxidation resistance by reducing the rate of oxide growth. Their cumulative effect is stronger than the influence of any one of them separately. In the presence of Ta even small amounts of Nb on the order of 0.2 to 0.5 wt % can have a significant effect on oxidation resistance (compare the preferred composition with EC3 and EC4 in FIG. 4).

The corrosion resistance of the alloy is determined mainly by the Cr content in the alloy. When tested in a corrosive environment ($NaSO_4/CaSO_4$ slag+air/$SO_2$ atmosphere) for 2000 hours, the various alloy compositions show depths of corrosion attack ranging from a few $\mu$m to mm. While CMSX4 (6.5 wt % Cr) is totally corroded, the preferred alloy compositions PC1, PC2, PC3 (11–15 wt % Cr) show signs of attack only within a 5 $\mu$m zone. Low Cr levels (<11%) result not only in low corrosion resistance, but also in a lower Al activity and hence, lower oxidation resistance. It is obvious from FIG. 1 that the Al activity increases significantly if the Cr level is >11%. Too high a Cr level, particularly in combination with a high Al content, however, significantly reduces low temperature ductility and fatigue life. At Cr levels exceeding 16 wt %, $\beta$ and $\gamma$ phases transform to $\alpha$-Cr and $\gamma'$ during service operation, resulting in a totally brittle phase structure.

Co increases the solubility of Al in the $\gamma$ matrix, and as a consequence, suppresses the amount of brittle phases (particularly $\sigma$) present in the alloy. Comparing the RT ductility of the specimens coated with EC2 and EC3 (Table 3) clearly demonstrates the beneficial role of Co.

The presence of Si in the alloy increases the activity of Al (FIG. 3) and, thus, increases its oxidation resistance. Si contents >2.5 wt %, however, must be avoided in order to prevent precipitation of brittle Ni (Ta, Si) phases. The beneficial role of Ta on oxidation performance, particularly when combined with Si, is already known from EP Patent. No. 0 241 807. However, computer modeling of the phase structure shows that in order to avoid embrittlement of the coating the combined content of (Si+Ta) must not exceed 2.5 wt %.

Commercial structural superalloys are strengthened not only by gamma prime forming elements (Al, Ti, Ta) but by additions of solid solution strengtheners such as Re, W, Mo, Cr, Co. Since W and Mo have been found to be detrimental to oxidation resistance they can be replaced by Re and Ta without loss in strength. From FIG. 2 it is clear that Re increases the activity of Al in the alloy, and, hence has a positive effect on oxidation performance. Re is also known to improve microstructural stability and reduce interdiffusion.

The improved coatings of this invention are also useful as bond coats for thermal barrier coatings TBC. A typical TBC system is a two-layer material system consisting of a ceramic insulator (e.g. $Y_2O_3$ partially stabilized $ZrO_2$) over an MCrAlY bond coat. Since TBC life significantly depends on the amount of oxide grown at the bond coat/ceramic interface, oxide growth rate and oxide scale adherence are among the life controlling parameters.

For an overlay coating (i.e. no TBC) the thermally grown oxide can spall and regrow repeatedly, however, for a TBC system oxide spallation during service is to be strictly avoided. Oxidation experiments were carried out on different coating compositions and the oxidation time (in hours) required until first spallation occurs was determined.

Figure 5:
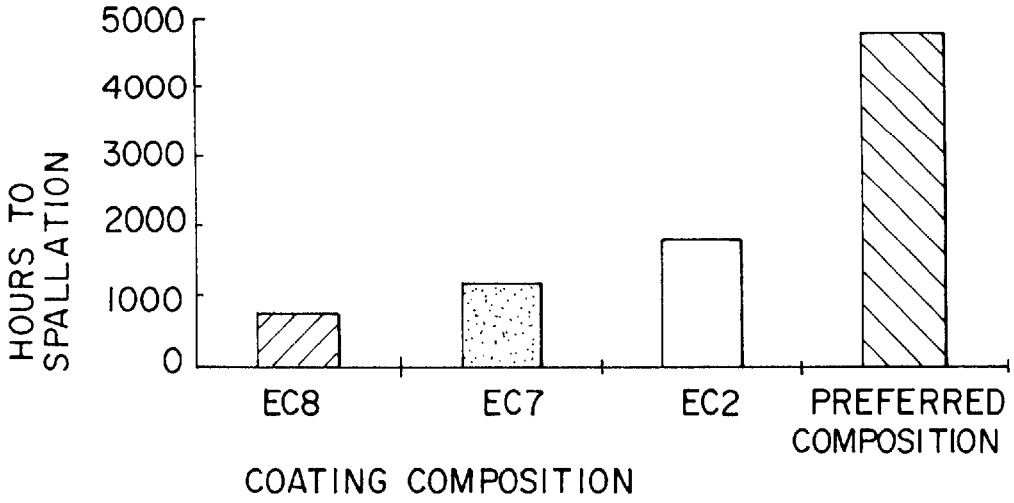
FIG. 5 is a bar graph showing the spallation time for first oxide scale spallation at 1050° C. as a function of the coating composition.

The data has been plotted in FIG. 5, where it can be seen that the time to first spallation which is indicative of the oxide scale adherence is longest for the preferred coating compositions PC1, PC2, PC3.

Of great importance for a TBC bond coat is also the formation of a protective $\alpha$-$Al_2O_3$ during the initial phase of oxidation. Transient oxides which have higher growth rates than $Al_2O_3$ add to the amount of oxide but not to its protective nature.

Hence, the presence of transient oxides at the bond coat/ceramic interface must be avoided or kept at a minimum. Different approaches, such as diffusion of Al or Pt, into the outer portion of the bond coat have been proposed to promote the formation of $\alpha$-$AL_2O_3$. Diffusion enriched layers, however, typically suffer from inferior mechanical properties due to the precipitation of brittle phases.

Figure 6A:
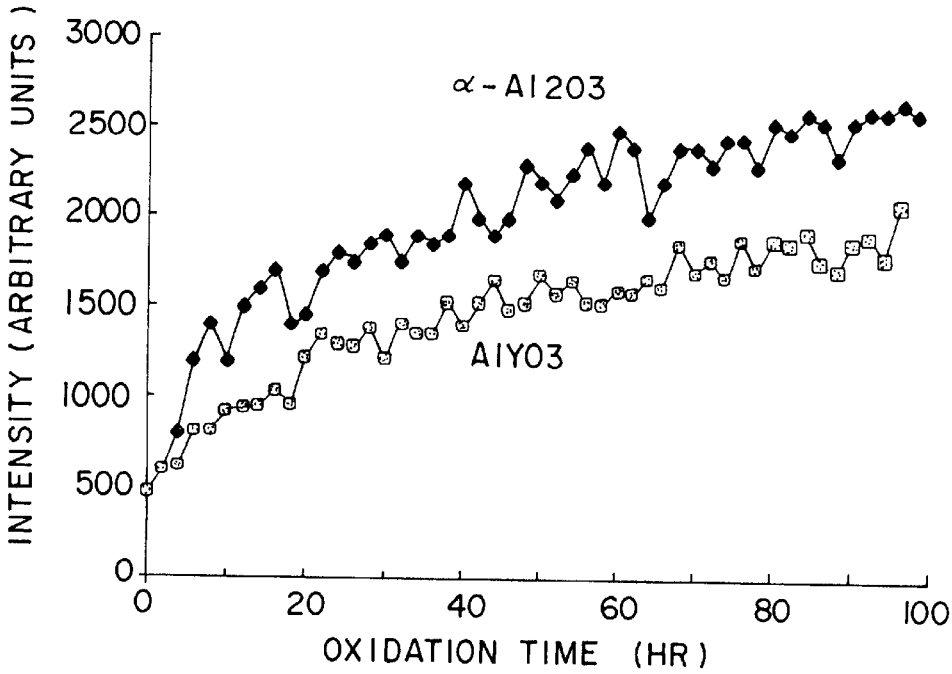
FIG. 6(*a*) is a graph showing the X-ray intensity as a function of oxidation time, by in situ X-ray analysis during oxidation at 1000° C., of the preferred compositions PC1, PC2, PC3.
Figure 6B:
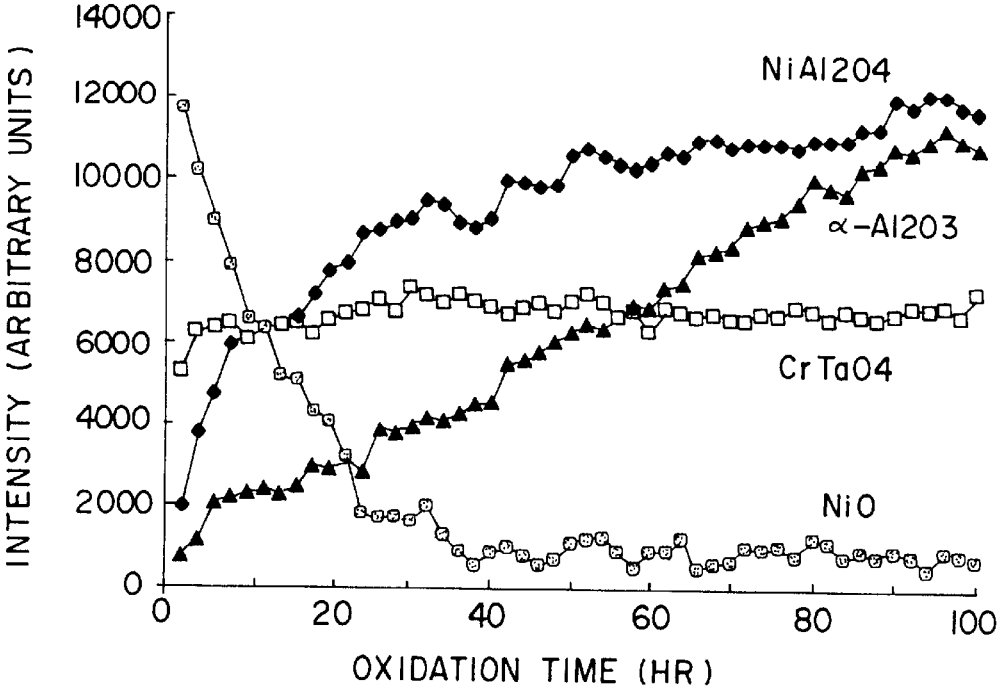

In situ X-ray analysis performed during oxidation of different alloys at 1000° C. revealed that a protective $\alpha AL_2O_3$ scale had formed on the preferred compositions PC1, PC2, PC3 within 1 hr of oxidation, and transient oxides could not be detected (even at glancing angle). In addition to $\alpha$-$AL_2O_3$, only $AlYO_3$ that grows close to the ($\alpha$-$AL_2O_3$/substrate interface and promotes the mechanical interlocking of the oxide scale appears in the X-ray spectrum. FIG. 6(*a*) shows the results of in situ X-ray analysis of the preferred composition, while FIG. 6(*b*) illustrates the case when transient oxide formation takes place.

Figure 7A:
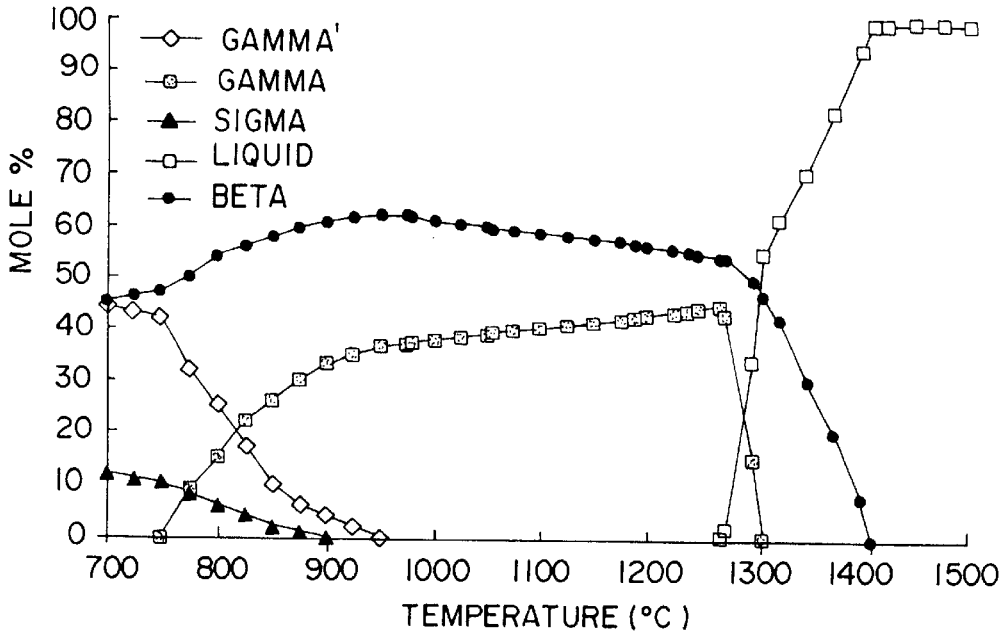
FIG. 7(*a*) is a graph showing the equilibrium phase structures for the preferred coating compositions.
Figure 7B:
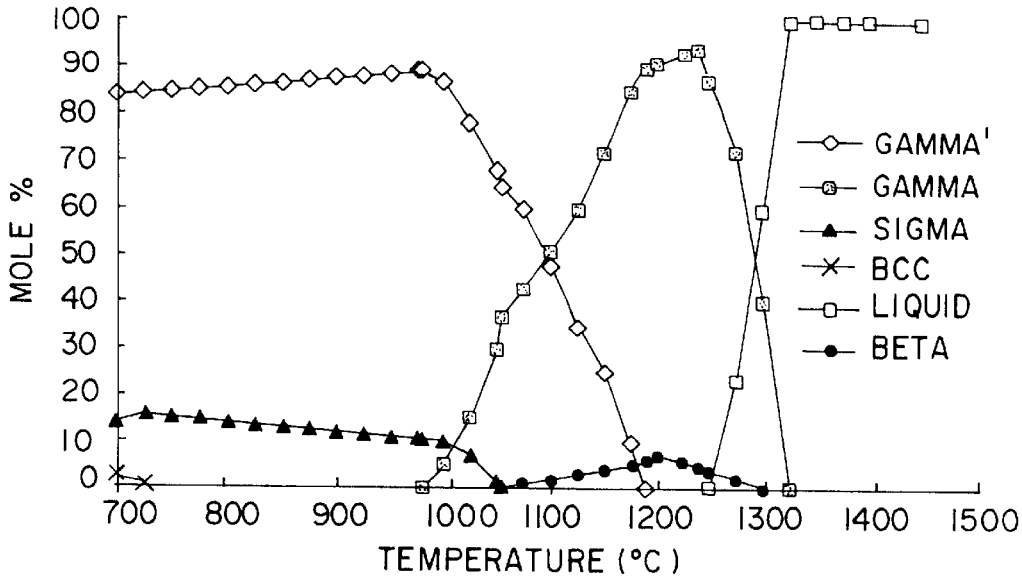

FIG. 7(*a*) shows the phases present in the preferred coating compositions as a result of computer modeling. The phase structure which consists of 45–60 vol % beta and 55–40 vol % gamma is seen to be stable over a wide temperature range (approx. 900–1280° C.). Upon cooling only a small alloy volume (<10 vol %) will undergo a detrimental phase transformation $\beta+\gamma \rightarrow \alpha+\gamma'$. This large region of phase stability makes the coatings rather insensitive to diffusion heat treatment temperatures. In contrast, computer modeling of experimental coating EC7 (FIG. 7(*b*)) yields a stable phase composition only at temperatures below 980° C. and yields massive phase transformations involving a large alloy volume above 980° C.

Figure 8:
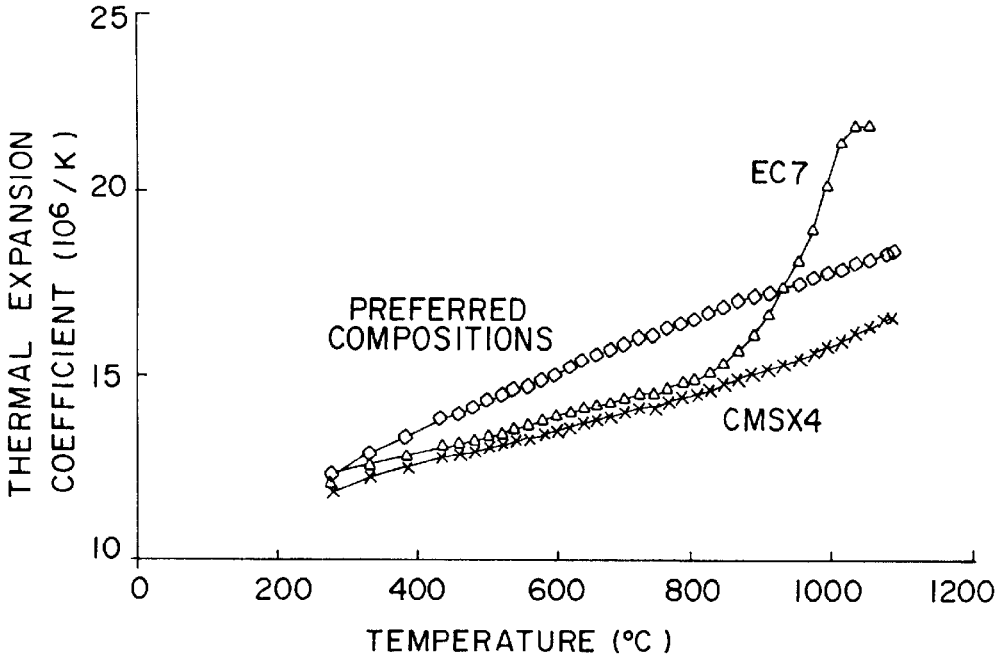
FIG. 8 is a graph showing the coefficients of thermal expansion of CMSX4, the experimental coating EC7, and of the preferred coating compositions as a function of temperature.

Phase transformations in the alloy during heating/cooling cycles have a pronounced effect on the physical properties and, as a consequence, on the mechanical behavior of the alloy. This is illustrated in FIG. 8 where the coefficients of thermal expansion are shown for CMSX4 (base alloy), the preferred alloy compositions and alloy EC7. While the preferred compositions and CMSX4 show nearly linear behavior over the whole temperature range, the deviation from linearity for EC7 coincides with the onset of phase transformations at a temperature of approximately 950° C. It is understood that large differences in thermal expansion between the coating and the substrate lead to high total mechanical strains in the coating.

We claim:

1. A coated substrate, comprising:

a substrate selected from the group consisting of Ni-base and Co-base superalloys; and a layer of a coating composition disposed on said substrate, said composition containing:

18 to 28 wt % of Co;
11 to 15 wt % of Cr;
11.5 to 14 wt % of Al;
1 to 8 wt % of Re;
1 to 2.3 wt % of Si;
0.2 to 1.5 wt % of Ta;
0.2 to 1.5 wt % of Nb;
0.3 to 1.3 wt % of Y;
0 to 1.5 wt % of Mg;
0 to 0.5 wt % of a total of La and La-series;
0 to 0.1 wt % of B;
less than 0.12 wt % of Hf;
less than 0.1 wt % of C; and
a balance of the coating to 100% of Ni;
provided that a total of Y, La, and La-series is from 0.3 to 1.8 wt %; and
a total of Si and Ta is equal to or less than 2.5 wt %.

2. The coated substrate according to claim 1, including: a layer of a thermal barrier coating disposed on said layer of the coating composition.

3. A coated substrate comprising:

a substrate;

a layer of a coating composition disposed on said substrate, said coating composition containing:

18 to 28 wt % of Co;
11 to 15 wt % of Cr;
11.5 to 14 wt % of Al;
1 to 8 wt % of Re;
1 to 2.3 wt % of Si;
0.2 to 1.5 wt % of Ta;
0.2 to 1.5 wt % of Nb;
0.3 to 1.3 wt % of Y;
0 to 1.5 wt % of Mg;
0 to 0.5 wt % of a total of La and La-series;
0 to 0.1 wt % of B;
less than 0.1 wt % of Hf;
less than 0.1 wt % of C; and
a balance of the coating to 100% of Ni;
provided that a total of Y, La, and La-series is from 0.3 to 1.8 wt %; and
total of Si and Ta is equal to or less than 2.5 wt %, and a layer of a thermal barrier coating disposed on said layer of said coating composition.

4. The coated substrate according to claim 3, wherein said coating composition contains:

about 24.1 wt % of Co;
about 11.8 wt % of Cr;
about 12.1 wt % of Al;
about 2.8 wt % of Re;
about 1 wt % of Si;
about 0.3 wt % of Y;
about 1 wt % of Ta; and
about 0.3 wt % Nb.

5. The coated substrate according to claim 3, wherein said coating composition contains:

about 23.8 wt % of Co;
about 13 wt % of Cr;
about 12 wt % of Al;
about 3 wt % of Re;
about 1.7 wt % of Si;
about 0.5 wt % of Y;
about 0.5 wt % of Ta;
about 0.3 wt % Nb; and
about 0.2 wt % of Mg.

6. The coated substrate according to claim 3, wherein said coating composition contains:

about 23.8 wt % of Co;
about 13 wt % of Cr;
about 11.8 wt % of Al;
about 3 wt % of Re;
about 1 wt % of Si;
about 0.3 wt % of Y;
about 1 wt % of Ta;
about 0.3 wt % Nb; and
about 0.1 wt % of La.

7. The coated substrate according to claim 3, wherein said coating composition contains a phase structure of ductile γ matrix containing β precipitates beneficial for oxidation and corrosion resistance and mechanical behavior.

8. The coated substrate according to claim 3, wherein said substrate is a substrate selected from the group consisting of Ni-base and Co-base superalloys.

9. A superalloy structural part, coated with a coating composition consisting essentially of: cobalt, 18–28% by weight; chromium, 11–15% by weight; aluminum, 11.5–14% by weight; rhenium, 1–8% by weight; silicon, 1–2.3% by weight; tantalum, 0.2–1% by weight, provided that the combined amounts of silicon and tantalum do not exceed 2.5% by weight; niobium, 0.2–1.5% by weight; yttrium, 0.3–1.3 by weight; a lanthanide series element, 0–0.5% by weight, provided that the combined amounts of yttrium and lanthanide series element are 0.3–1.8% by weight; magnesium, 0–1.5% by weight; boron, 0–0.1% by weight; hafnium, less than 0.1% by weight; carbon, less than 0.1% by weight, and the balance to 100% by weight nickel and incidental impurities.

10. The coated structural part of claim 9, wherein the coating composition comprises (in wt %):

| | | | |
|---|---|---|---|
| Ni | balance | Si | 1 |
| Co | 24.1 | Y | 0.3 |
| Cr | 11.8 | Ta | 1 |
| Al | 12.1 | Re | 2.8. |
| Nb | 0.3 | | |

11. The coated structural part of claim 9, wherein the coating composition comprises (in wt %):

| | | | |
|---|---|---|---|
| Ni | balance | Si | 1.7 |
| Co | 23.8 | Y | 0.5 |
| Cr | 13 | Ta | 0.5 |
| Al | 12 | Mg | 0.2 |
| Re | 3 | Nb | 0.3. |

12. The coated structural part of claim 9, wherein the coating composition comprises (in wt %):

| | | | |
|---|---|---|---|
| Ni | balance | Y | 0.3 |
| Co | 23.8 | Ta | 1 |
| Cr | 13 | Nb | 0.3 |
| Al | 11.8 | Mg | 0.001 |
| Re | 3 | La | 0.1. |
| Si | 1 | | |

13. The coated structural part of claim 9, wherein the coating composition comprises a phase structure of ductile γ matrix containing β precipitates being beneficial for oxidation/corrosion resistance and mechanical behavior.

14. The coated structural part of claim 9, wherein the coating composition comprises a layer on a substrate selected from the group consisting of Ni-base and Co-base superalloys.

15. The coated structural part of claim 9, wherein the coating composition comprises a layer on a substrate and is further provided with a top layer of a thermal barrier coating.

* * * * *